US007866334B2

(12) United States Patent
McIntire

(10) Patent No.: US 7,866,334 B2
(45) Date of Patent: Jan. 11, 2011

(54) SEWER PIPE GAS EXHAUST FILTER APPARATUS

(76) Inventor: Mark McIntire, 2902 NW. 59th St., Kansas City, MO (US) 64151

( * ) Notice: Subject to any disclaimer, the term of this patent is extended or adjusted under 35 U.S.C. 154(b) by 941 days.

(21) Appl. No.: 11/504,197

(22) Filed: Aug. 15, 2006

(65) Prior Publication Data

US 2007/0033719 A1 Feb. 15, 2007

Related U.S. Application Data

(60) Provisional application No. 60/708,203, filed on Aug. 15, 2005.

(51) Int. Cl.
*F16K 24/04* (2006.01)

(52) U.S. Cl. ..... 137/199; 137/388; 137/433; 137/434

(58) Field of Classification Search ..... 137/197, 137/199, 202, 315.04, 388, 433, 434; 210/133, 210/136, 424; 96/109, 113; 4/219, 220, 4/209 FF See application file for complete search history.

(56) References Cited

U.S. PATENT DOCUMENTS 154,645 A 9/1874 Chase
4,586,941 A 5/1986 Cooley
4,770,201 A 9/1988 Zakai
5,535,588 A * 7/1996 Peterson et al. ..... 60/454
5,846,274 A 12/1998 Smelser
6,146,435 A 11/2000 Stork
6,379,429 B1 4/2002 Scranton, Jr.
6,379,433 B1 4/2002 Scranton, Jr.
6,848,465 B1 2/2005 Ledbetter
2006/0185732 A1 * 8/2006 Katzman et al. ..... 137/202

* cited by examiner

*Primary Examiner*—John Rivell
*Assistant Examiner*—Craig Price
(74) *Attorney, Agent, or Firm*—Hovey Williams LLP

(57) ABSTRACT

A sewer pipe gas exhaust filter apparatus includes a sewer vent valve unit connected to a sewer pipe and including a valve member moved into and out of engagement with a valve seat by a float member, a gas filter unit connected to the sewer vent valve unit and including a gas filter medium, and a gas flow valve arrangement to cause gases from the sewer to flow through the filter medium while bypassing air drawn into the sewer pipe past the gas filter unit. The filter medium of the gas filter unit removes chemical components from air and gas exhausted from the sewer pipe, thereby improving the odor of such exhausted gases.

9 Claims, 2 Drawing Sheets

SEWER PIPE GAS EXHAUST FILTER APPARATUS

CROSS-REFERENCE TO RELATED APPLICATION

This application claims priority under 35 U.S.C. 119(e) and 37 C.F.R. 1.78(a)(4) based upon copending U.S. Provisional Application, Ser. No. 60/708,203 for SEWER PIPE GAS EXHAUST ODOR ELIMINATION DEVICE, filed Aug. 15, 2005, the disclosure of which is incorporated herein.

BACKGROUND OF THE INVENTION

The present invention relates to sewer venting devices and, more particularly, to a sewer venting device which filters sewer gases vented to the atmosphere.

Sanitary sewer pipes or sewers carry raw sewage to treatment plants where the sewage is treated. Flow problems and other problems can develop as a result of accumulated pockets of gases within a sewer line. On the other hand, there are situations in which vacuums can occur which can also cause flow problems and structural problems. For these reasons, it is sometimes necessary to vent gases from sewers to the atmosphere to prevent pockets of gases from accumulating, and at other times it is necessary to draw air from the atmosphere into the sewer lines to prevent the development of vacuum conditions. At all times, it is necessary to prevent raw sewage from being released at such points of venting and/or admission of air.

Where possible, sewage systems are designed to allow sewage to flow by gravity to a treatment plant. However, in hilly areas, pressurized sewage techniques are needed in some locations to pump the sewage uphill on the way to a treatment plant. Typically, such systems make use of so-called "wet wells" which are collection reservoirs. When the level of sewage in the wet well rises to a selected level, a pump or pumps are activated to pump sewage out of the wet well and over a hill toward a treatment plant or to the next wet well. Initially, the sewer pipe is filled with air at ambient pressure. When the pump begins pushing the sewage along the sewer line, it is necessary to vent air from the pipe to enable the sewage to flow. When the sewage level in the wet well drops to an acceptable level, the pumps are deactivated. When the pumps are stopped, sewage within the line at the top of a hill tends to flow downhill in both directions from the hilltop. Unless air is allowed to be drawn into the sewer pipe at the hilltop, sewage flow is inhibited and vacuums can occur which can reach levels that will cause the sewer pipe to collapse.

Sewer venting valve arrangements have been developed to enable the outflow of gases from sewers and the inflow of air into sewers, while preventing the discharge of liquids and their suspended solids from the sewer. The model D-020 Combination Air Valve for Sewage, manufactured by A. R. I. Flow Control Accessories (www.arivalves.com or www.ari-.co.il) is an example of such a valve. The model D-025 is a similar type of sewer venting valve. This sewer venting valve has a vertically elongated housing which connects to a sewer pipe at a lower end within a access chamber or manhole, a valve and seat at an upper end controlling flow to an outlet, and a valve control rod with a float on a lower end and connected to the valve at an upper end of the rod. The valve is normally in an open position such that gases can flow out from the sewer pipe or air can be drawn into the sewer, as necessary. However, the presence of a liquid within the housing raises the float, causing the valve to seat to prevent sewage from being discharged through the venting valve.

Such a sewer venting valve can be installed in communication with a sewer pipe at a hilltop location of a pressurized sewer system. The sewer venting valve allows air to be vented from the sewer pipe when the pipe is pressurized, prevents sewage liquids from being discharged when flow past the venting valve occurs, and allows air to be drawn back into the pipe when the pumps are deactivated to prevent vacuum conditions from forming within the pipe.

A problem with venting air and gases from a sewer pipe is the discharge of malodorous compounds within such gases which typically occur in sewage, including principally hydrogen sulfide and also methyl mercaptan, organic sulfides, amines, and other nitrogen and sulfur containing compounds.

SUMMARY OF THE INVENTION

The present invention combines a sewer venting valve unit with a gas filter unit and valving arrangement to control the direction of flow of gases through the gas filter unit. The sewer venting valve unit includes a housing communicating with a sewer pipe at a lower end with an outlet at an upper end spaced from the lower end. A sewage valve with a valve seat is positioned within the housing to control outflow through the outlet. A control rod is connected to the sewage valve at an upper end and has a float at a lower end. The weight of the float and control rod hold the sewage valve in a normally open position. When liquid sewage enters the housing at the lower end, the float is raised which closes the valve by way of the control rod to prevent sewage from being discharged through the valve outlet.

The outlet of the sewer venting valve unit is connected to a filter unit to filter gases outflowing from the sewer. The filter unit contains a gas filter medium such as activated carbon, charcoal, compost, or other material which will react with compounds in the gases from the sewage to thereby eliminate the discharge of offensive odors from the sewer pipe when gases are vented therefrom. The filter unit includes an outlet check valve and an inlet check valve. The check valves cooperate to cause gases from the sewer pipe to be channeled through the filter medium and to bypass air drawn into the sewer pipe past the filter to thereby extend the life of the filter medium. The sewer venting valve unit and the filter unit are typically located in an access chamber or manhole located at a hilltop location along the sewer pipe.

Objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

Figure 1:
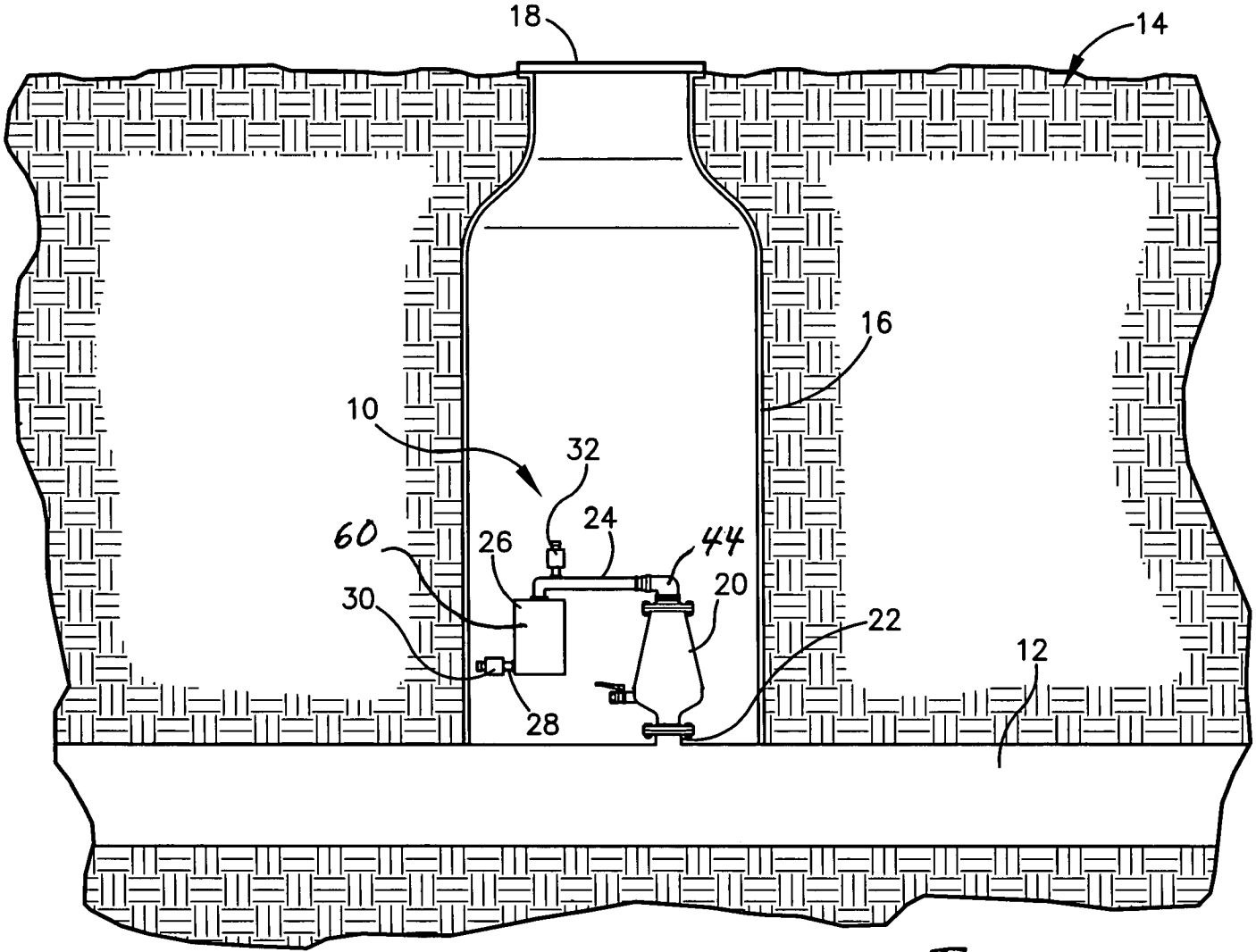
FIG. 1 is a diagrammatic cross sectional view of a sewer pipe gas exhaust filter apparatus which embodies the present invention, shown installed within a manhole chamber.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 10 generally designates a sewer gas exhaust filter apparatus according to the present invention. The apparatus 10 generally includes a sewer vent valve unit 20 connected to a sewer pipe 12 (FIG. 1) and a gas exhaust filter unit 26. The vent valve unit 20 and gas filter unit 26 cooperate to allow gas from the sewer pipe 12 to flow out and filter the same, to allow air to flow into the sewer pipe 12, and to prevent liquids from flowing out of the sewer pipe 12.

The sewer vent valve unit 20 is connected to the sewer pipe 12 of a pressurized sewage system (not shown) by way of a flanged stem 22, preferably at a hilltop location along the pipe 12. Such a hill top location is beneficial in relieving vacuum conditions which can occur when pumps (not shown) of the pressurized sewage system are deactivated. An access chamber or manhole 16 is provided in the ground 14 at the hilltop location to provide for installation of the apparatus 10. The manhole 16 may be closed at a top end by a manhole cover 18. Manholes 16 are typically lined with concrete and may include a drain (not shown) at a lower end to drain away rain water which might otherwise flood the manhole 16.

Figure 2:
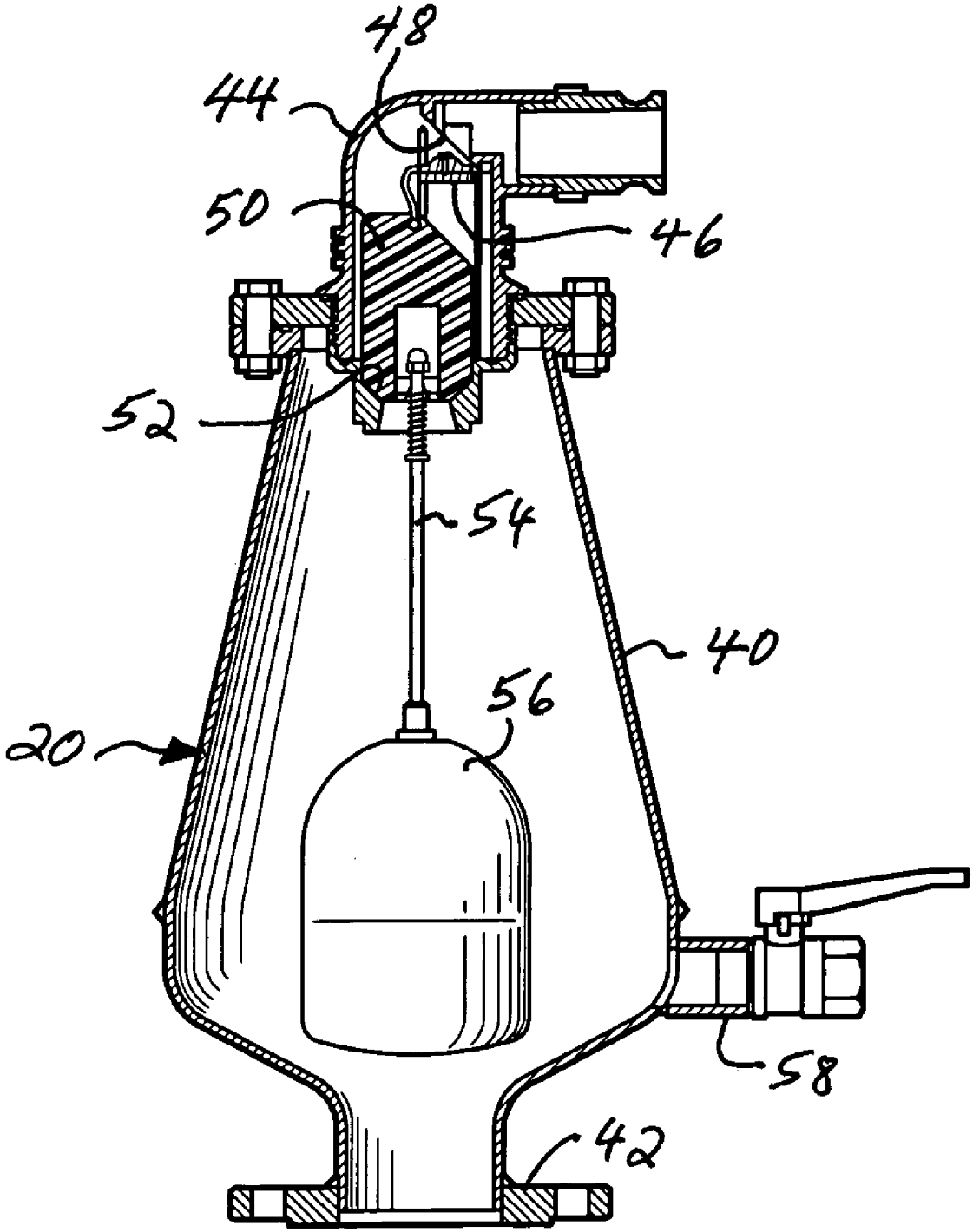
FIG. 2 is longitudinal cross sectional view of an exemplary sewer venting valve unit which may be employed in the present invention.

Referring to FIG. 2, the illustrated sewer vent valve unit 20 includes a vertically elongated valve housing 40 which tapers sharply at a lower end to an inlet fitting 42 and tapers more gradually toward an upper end, at which is connected an outlet fitting 44. The names of the outlet and inlet fittings 42 and 44 are referenced to the direction of flow during venting from the sewer pipe 12. When air is drawn into the pipe 12, the roles of the fittings 42 and 44 are reversed. The housing 40 is connected in flow communication with the pipe 12 by connection of the fitting 42 to the stem 22 of the pipe 12. Within the outlet fitting 44, a pivotable valve member 46 is positioned in spaced relation to a valve seat 48. The illustrated valve unit 20 is provided with an upper float 50 which is slidably mounted in the fitting 44 and connected to the valve member 46. Downward movement of the upper float 50 is limited by engagement with a shoulder 52 within the fitting 44. A valve control rod 54 is connected to the upper float 50 and depends therefrom toward the fitting 42. A lower or main float 56 is connected to the lower end of the control rod 54.

The combined weight of the upper float 50, the control rod 54, and the main float 56 is sufficient to normally hold the valve member 46 in an open position to enable free flow of air or gases out of or into the valve unit 20. However, if liquid from the sewer pipe 12 enters the housing 40 and rises to a sufficient level, the buoyance of the main float 56 causes the float 56 to rise, thereby pivoting the valve member 46 to engage the valve seat 48. Any air trapped within the housing 40 becomes compressed, thereby limiting further influx of liquids into the housing 40. The length of the housing 40 of the illustrated valve unit 20 is selected to provide sufficient separation of the valve member and valve seat 46 and 48 from the inlet 42 to enable the float 56 to close the valve 46 before the level of liquid reaches the outlet 44. Additionally, the shape of the housing 40 is configured to promote positive draining of liquids from the housing 40. The valve unit 20 may be provided with a valved connection 58 for backflow cleaning purposes. The illustrated sewer valve unit 20 is an exemplary configuration of a sewer vent valve; however, the use of other configurations of such valves, which perform similar functions, is foreseen.

Referring to FIG. 1, the outlet 44 of the valve unit 20 is connected by a conduit 24 to an entrance end of the filter unit 26. The filter unit 26 includes the conduit 24 and a filter medium canister 60. The canister 60 may be of a generally cylindrical shape and has a gas filter medium positioned therein, such as an activated carbon, a charcoal, certain types of composted materials, or other suitable material for filtering selected chemical components from gases discharged from the sewer pipe 12. Preferably, the gas filter medium is of such a nature as to significantly improve the odor of gases vented from the pipe 12. Since all filter media become saturated or otherwise expended over time, periodic replacement of the filter medium will be necessary.

It is only necessary for gases flowing out of the pipe 12 to be filtered; air flowing into the pipe 12 need not be filtered. The illustrated filter unit 26 is provided with an outlet check valve 30 connected to the canister 60 through a vent stem 28 which allows gas to flow out of the filter unit 26, but prevents air from being drawn into the canister 60. An inlet check valve 32 is connected to the conduit 24 to allow air to flow into the sewer pipe 12 through the valve unit 20, but prevents gas flow from the sewer pipe 12 from bypassing the filter unit 26. It is foreseen that other valving arrangements could be devised to accomplish the flow control functions of the illustrated check valves 30 and 32.

In use, the valve unit 20 allows air and gases to be vented therethrough, through the filter unit 26, and out the outlet check valve 30 to relieve positive pressure within a sewer pipe 12, particularly when it is pressurized to move sewage downstream from a wet well (not shown). The filter unit 26 filters such outflowing gases to remove odors therefrom. When liquid sewage under pressure enters the housing 40 of the valve unit 20, the float 56 pivots the valve member 46 into seating engagement with the valve seat 48 to prevent discharge of liquid sewage from the valve unit 20. When pressurization is relaxed, the valve unit 20 allows air to enter the sewer pipe 12 to prevent the formation of vacuum conditions within the sewer pipe 12. The inlet check valve 32 allows air being drawn into the pipe 12 through the valve unit 20 to bypass the filter unit 26. Although the apparatus 10 has been described in association with a hilltop location, the present invention is not intended to be restricted to use at such a location.

It is to be understood that while certain forms of the present invention have been illustrated and described herein, it is not to be limited to the specific forms or arrangement of parts described and shown.

What is claimed and desired to be secured by Letters Patent is:

1. A sewer venting apparatus for use in venting sewer gases out of and into a sewer pipe adapted to carry liquid sewage and comprising:

(a) a sewer vent valve mechanism having an input communicating with a sewer pipe and an output, said valve mechanism enabling outflow of the sewer gases from said sewer pipe and inflow of air from the atmosphere into said sewer pipe while preventing outflow of the liquid sewage through said vent valve mechanism;

(b) a conduit in communication with said vent valve output;

(c) a one-way inlet check valve in flow communication with said conduit to enable flow of air into the conduit;

(d) a gas filter unit communicating downstream of both of said output of said valve mechanism and said conduit, and configured and oriented to filter substantially all the sewer gases outflowing from said conduit through said filter comprising a filter medium canister for removing offensive odors from the sewer gases;

(e) a vent stem in flow communication with said filter unit; and (f) a one-way outlet check valve in flow communication with said vent stem and enabling outflow of gas from said vent valve mechanism into the atmosphere, and wherein substantially all the air flowing through the one-way inlet check valve bypasses the gas filter unit and substantially all the sewer gases flowing through the one-way outlet check valve passes through the gas filter unit.

2. An apparatus as set forth in claim 1 wherein said filter medium canister comprises:

(a) a carbon medium to filter selected chemical components from said sewer gases.

3. An apparatus as set forth in claim 1 wherein said sewer vent valve mechanism includes:

(a) an elongated housing having said input at a lower end which is in flow communication with said sewer pipe and said outlet at an upper end, said output being vertically spaced from said input;

(b) a sewer vent valve member with a valve seat, said sewer vent valve member enabling flow through said valve seat when separated therefrom and preventing flow when engaged with said valve seat;

(c) a valve control rod connected at an upper end to said sewer vent valve member and having a lower end;

(d) a buoyant float member secured to said lower end of said valve control rod;

(e) said float member having sufficient weight to hold said valve member in an open position in the absence of the liquid within said housing to enable outflow of the sewer gases from said sewer pipe and inflow of air into said sewer pipe; and (f) said float member being raised by the sewage liquid within said housing at a selected height and closing said valve member by way of said control rod to thereby prevent discharge of the sewage liquid through said outlet of said sewer vent valve mechanism.

4. A sewer venting apparatus for use in venting gases out of and into a sewer pipe adapted to carry liquid sewage and comprising:

(a) a sewer vent valve mechanism having an input communicating with a sewer pipe and an output, said valve mechanism enabling outflow of the sewer gases from said sewer pipe and inflow of air from the atmosphere into said sewer pipe while preventing outflow of the liquid sewage through said vent valve mechanism;

(b) a gas filter unit communicating downstream of both of said output of said valve mechanism and said conduit, and configured and oriented to filter the sewer gases outflowing from said valve mechanism through said filter and into the atmosphere; and (c) a filter check valve assembly engaged with said filter unit in such a manner as to cause substantially all the sewer gases outflowing from said sewer vent valve mechanism to flow through said filter unit and substantially all air drawn into said sewer vent valve mechanism to bypass said filter unit.

5. An apparatus as set forth in claim 4 wherein said filter check valve assembly includes:

(a) a one-way outlet check valve in flow communication with said filter unit and enabling outflow of said sewer gases from said vent valve mechanism through said filter unit; and (b) a one-way inlet check valve in flow communication with said vent valve mechanism to enable flow of air into said vent valve mechanism without passing through said filter unit.

6. An apparatus as set forth in claim 4 wherein said gas filter unit includes:

(a) an activated carbon medium positioned in said gas filter unit to filter selected chemical components from said sewer gases.

7. An apparatus as set forth in claim 4 wherein said sewer vent valve mechanism includes:

(a) an elongated housing having said input at a lower end which is in flow communication with said sewer pipe and said outlet at an upper end, said output being vertically spaced from said input;

(b) a sewer vent valve member with a valve seat, said sewer vent valve member enabling flow through said valve seat when separated therefrom and preventing flow when engaged with said valve seat;

(c) a valve control rod connected at an upper end to said sewer vent valve member and having a lower end;

(d) a buoyant float member secured to said lower end of said valve control rod;

(e) said float member having sufficient weight to hold said valve member in an open position in the absence of the liquid sewage within said housing to enable outflow of said sewer gases from said sewer pipe and inflow of air into said sewer pipe; and (f) said float member being raised by the liquid sewage within said housing at a selected height and closing said valve member by way of said control rod to thereby prevent discharge of the liquid sewage through said outlet of said sewer vent valve mechanism.

8. A sewer venting apparatus for use in venting sewer gases out of and into a sewer pipe adapted to carry liquid sewage and comprising:

(a) a sewer vent valve mechanism having an input communicating with a sewer pipe and an output, said valve mechanism enabling outflow of the sewer gases from said sewer pipe and inflow of air from the atmosphere into said sewer pipe while preventing outflow of the liquid sewage through said vent valve mechanism, said vent valve mechanism including:

(1) an elongated housing having said input at a lower end which is in flow communication with said sewer pipe and said outlet at an upper end, said output being vertically spaced from said input;

(2) a sewer vent valve member with a valve seat, said sewer vent valve member enabling flow through said valve seat when separated therefrom and preventing flow when engaged with said valve seat;

(3) a valve control rod connected at an upper end to said sewer vent valve member and having a lower end;

(4) a buoyant float member secured to said lower end of said valve control rod;

(5) said float member having sufficient weight to hold said valve member in an open position in the absence of the liquid sewage within said housing to enable outflow of said sewer gases from said sewer pipe and inflow of air into said sewer pipe; and (6) said float member being raised by the liquid sewage within said housing at a selected height and closing said valve member by way of said control rod to thereby prevent discharge of the liquid sewage through said outlet of said sewer vent valve mechanism.

(b) a gas filter unit communicating downstream of both of said output of said valve mechanism and said conduit, and configured and oriented to filter substantially all the sewer gases outflowing from said valve mechanism through said filter and into the atmosphere, said gas filter unit comprising an activated carbon medium positioned in said gas filter unit to filter selected chemical components from said sewer gases; and (c) a filter check valve assembly engaged with said filter unit in such a manner as to cause said sewer gases outflowing from said sewer vent valve mechanism to flow through said filter unit and air drawn into said sewer vent valve mechanism to bypass said filter unit; said filter check valve assembly including:

(1) a one-way outlet check valve in flow communication with said filter unit and enabling outflow of said sewer gases from said vent valve mechanism through said filter unit; and (2) a one-way inlet check valve in flow communication with said vent valve mechanism to enable flow of air into said vent valve mechanism without passing through said filter unit.

9. A sewer venting apparatus for use in venting sewer gases out of and into a sewer pipe and adapted to carry liquid sewage and comprising:

(a) a sewer vent valve mechanism having an input communicating with a sewer pipe and an output, said valve mechanism enabling outflow of said sewer gases from said sewer pipe and inflow of air from the atmosphere into said sewer pipe while preventing outflow of said liquid sewage through said vent valve mechanism, said vent valve mechanism comprising:

(1) an elongated housing having said input at a lower end which is in flow communication with said sewer pipe and said outlet at an upper end, said output being vertically spaced from said input;

(2) a sewer vent valve member with a valve seat, said sewer vent valve member enabling flow through said valve seat when separated therefrom and preventing flow when engaged with said valve seat;

(3) a valve control rod connected at an upper end to said sewer vent valve member and having a lower end;

(4) a buoyant float member secured to said lower end of said valve control rod;

(5) said float member having sufficient weight to hold said valve member in an open position in the absence said liquid sewage within said housing to enable outflow of said sewer gases from said sewer pipe and inflow of air into said sewer pipe; and (6) said float member being raised by said liquid sewage within said housing at a selected height and closing said valve member by way of said control rod to thereby prevent discharge of liquid through said outlet of said sewer vent valve mechanism, (b) a pipe in flow communication with said outlet of said valve mechanism having a first end and a second end wherein the first end is connected to the outlet of said valve mechanism;

(c) a one-way inlet check valve in flow communication with said pipe to enable flow of air into said vent valve mechanism without passing through a gas filter unit;

(d) the gas filter unit connected to and in flow communication with said second end of said pipe at a first end of the gas filter unit to thereby filter substantially all said sewer gases outflowing from said valve mechanism through said filter and into the atmosphere, said gas filter unit comprising a composited material medium positioned in said gas filter unit to filter selected chemical components from said sewer gases; and (e) a one-way outlet check valve in flow communication with said filter unit at a second end of the gas filter unit and enabling outflow of said sewer gases from said vent valve mechanism through said filter unit.

* * * * *